US005651244A

United States Patent [19]

Lucca et al.

[11] Patent Number: 5,651,244

[45] Date of Patent: Jul. 29, 1997

[54] RING SPINNING METHOD AND A YARN MADE THEREBY

[75] Inventors: Angelo Lucca, Seuzach; Herbert Stalder, Kollbrunn, both of Switzerland

[73] Assignee: Rieter Machine Works, Ltd., Winterthur, Switzerland

[21] Appl. No.: 488,124

[22] Filed: Jun. 7, 1995

[30] Foreign Application Priority Data

Jun. 23, 1994 [DE] Germany ..... 44 22 023.5
Oct. 26, 1994 [CH] Switzerland ..... 03208/94

[51] Int. Cl.[6] ..... D01H 7/52; D01H 5/28

[52] U.S. Cl. ..... 57/75; 57/315; 57/328; 57/351

[58] Field of Search ..... 57/315, 316, 317, 57/328, 350, 351, 75

[56] References Cited

U.S. PATENT DOCUMENTS

| | | | |
|---|---|---|---|
| 3,122,794 | 3/1964 | Klein | 19/288 |
| 4,290,170 | 9/1981 | Brookstein et al. | 57/315 |
| 4,332,059 | 6/1982 | Bischofberger et al. | 19/244 |
| 4,488,397 | 12/1984 | Venot | 57/328 |
| 4,953,349 | 9/1990 | Fehrer | 57/315 |
| 5,085,046 | 2/1992 | Fehrer | 57/75 |
| 5,090,192 | 2/1992 | Stahlecker | 57/315 |
| 5,157,911 | 10/1992 | Stahlecker et al. | 57/328 |
| 5,323,598 | 6/1994 | Stahlecker et al. | 57/315 |
| 5,431,005 | 7/1995 | Fehrer | 57/315 |

FOREIGN PATENT DOCUMENTS

| | | |
|---|---|---|
| 3927936A1 | 4/1990 | Germany . |
| 4141237 | 7/1992 | Germany . |
| 4132919A1 | 4/1993 | Germany . |

OTHER PUBLICATIONS

Uster Statistics "Mass Variation Co Carded Rink" Co–Type pp. 18,20,21&23 No Translation 1989.

*Primary Examiner*—William Stryjewski
*Attorney, Agent, or Firm*—McAulay Fisher Nissen Goldberg & Kiel, LLP

[57] ABSTRACT

The ring spinning method drafts a silver in a multi-stage drafting system where the silver acquires a total draft in a range of from 60 to 150-fold. Following outlet from the last nip of the drafting system, the drafted silver is conveyed without drafting over a guide path in which the fiber band is condensed to form a compact fiber strand of not more than 2.5 millimeters width and preferably less than 15 millimeter in width. At the end of the guide path, the fiber strand passes through a twist inhibiting nip between two rollers and is then passed by twist distribution to a ring spinning device. The yarn produced possesses a high quality with respect to hairiness and neps.

13 Claims, 1 Drawing Sheet

RING SPINNING METHOD AND A YARN MADE THEREBY

Figure 1:
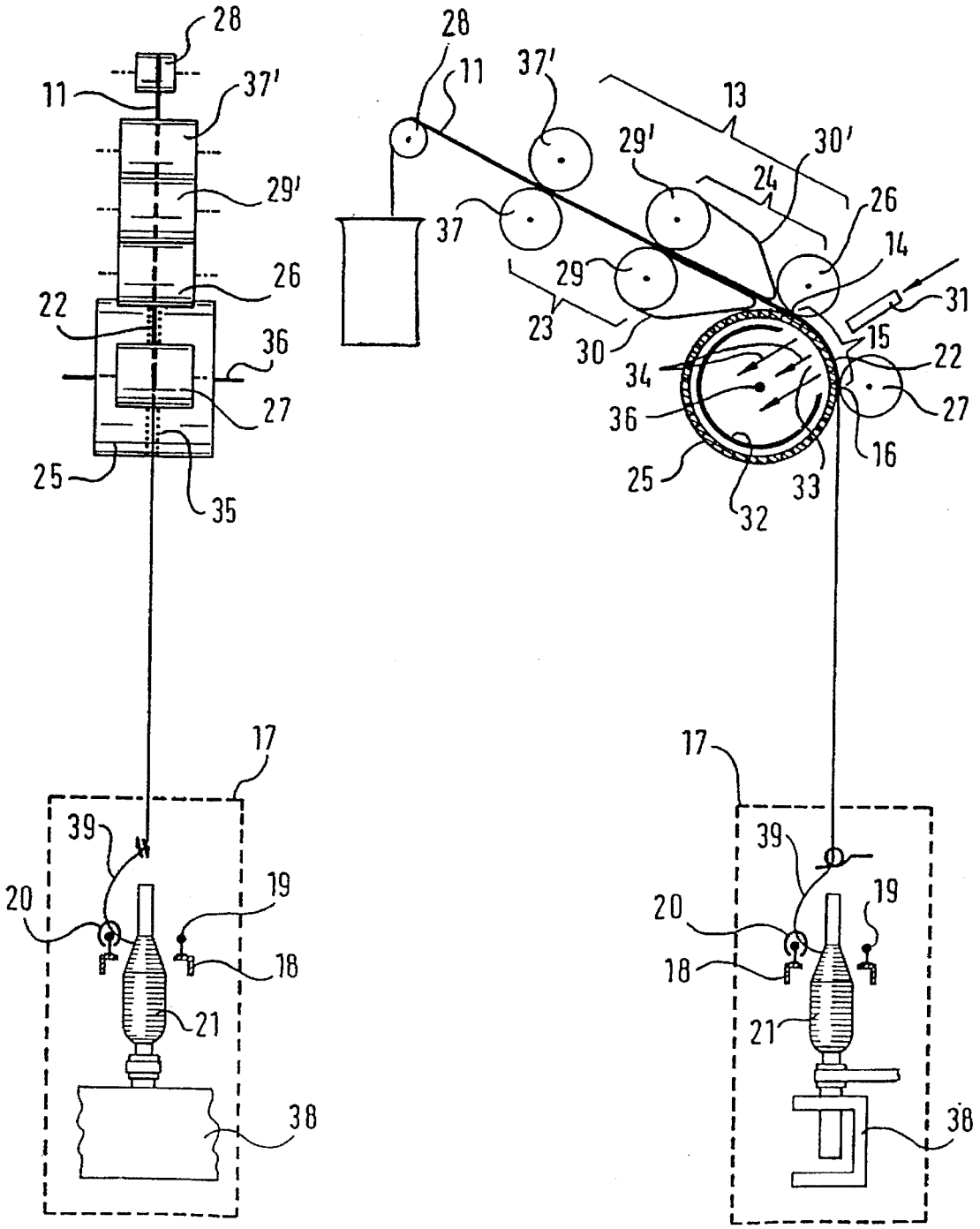

This invention relates to a ring spinning method and a yarn made thereby.

Heretofore, various types of techniques have been known for the spinning of fibers into yarn. For example, German OS 39 27 936 A1 describes a ring spinning method wherein one or two rovings are guided in parallel relation to one half of a drafting system where the rovings are drawn with standard draft values and then delivered without further drafting to an aerodynamic fiber compression system on a perforated suction roller. In the described method, an aerodynamically compact compression of the roving (i.e. silver) takes place on the surface of the perforated suction roller (i.e a drum). A positive effect is thus achieved by separation of the processes of drafting and condensing of the fibers. In order to bring about compression, the already drawn silver which is held on the surface of the suction roller by a current of suction air, is deflected in the direction of its axis so that the fibers within the silver are drawn in a parallel alignment and bunched together as a result of juxtaposing the individual fibers by means of a transverse movement. In general, the process initiated by the suction action is promoted by the action of a blown air current impinging on the surface so that, during transfer to a nip line for the twisting process, the separate fibers are held in a stable equilibrium between the applied air currents.

The aerodynamic compression of the fibers which follows the main draft produces a compact fiber strand of about one millimeter in width or less which also forms the base of a spinning triangle following a twist inhibiting nip. The height of the spinning triangle is thus reduced accordingly. The aerodynamic bunching of the fibers can thus affect the twisting of the silver.

Ring spinning machines normally use three-cylinder drafting systems. In this case, the middle pair of cylinders located at the start of a high-draft zone are generally equipped with double aprons which extend to a point close to the intake nip of a pair of delivering rollers.

Depending on the fineness of the yarn, three-cylinder drafting systems are usually fed with a roving having drafts of from 25 to 50-fold; the higher drafts corresponding to finer yarn counts.

As described in German OS 41 41 237 A1 and 41 32 919 A1, mechanical condensers have also been used between the ends of the aprons and a main draft zone and a nip between the delivery cylinders of a drafting system for the purpose of bunching the roving. However, the improvement in yarn quality which is attainable by these mechanical condensers is limited since the friction of the individual fibers on the condenser guide elements results in irregularities in the yarn. For this reason, condensers located at the end of the main draft zone do not yet constitute an optimum means for significantly improving yarn quality.

However, by bunching the roving in the high-draft zone before entry into the delivery nip of the drafting system, it is possible to increase the total draft of the drafting system to values approaching 60-fold without the base of the spinning triangle assuming unacceptably high values. Even in such a high-efficiency drafting system, higher drafts would impair the yarn quality.

Accordingly, it is an object of the invention to provide a ring spinning method in which both efficiency and yarn quality can be substantially increased.

It is another object of the invention to be able to draft a yarn at a high draft while at least maintaining yarn quality.

It is another object of the invention to be able to use known equipment in a unique manner so as to obtain higher efficiency and yarn quality.

Briefly, the invention provides a ring spinning method which includes a step of drafting a fiber stand in a multi-stage drafting system to a total draft in a range of from 60 to 150-fold. In accordance with the invention, the drafted fiber stand is conveyed from the drafting system without drafting over a defined guide path to a twist inhibiting nip between two rollers while being condensed along the guide path to form a compact fiber strand of not more than 2.5 millimeters in width. Thereafter, the compact fiber strand is delivered while being twisted to a ring spinning device for twisting into a fully spun yarn having a fineness within a range from Ne 6 to Ne 16.

The method is based upon a known compact spinning process but also comprises other types of silver condensing or compacting systems after the main draft zone in a draft-free area leading to the twist inhibiting nip.

While the total drafts of conventional ring spinning drafting systems were limited to a maximum value of 60-fold due to the fact that sensitive quality losses are to be anticipated at higher drafts, the draft range according to the invention commences above the value of 60 hitherto considered as the outer limit and ranges to a value of 120-fold, the draft range of 80 to 100-fold representing an optimum in respect of the yarn quality achieved. In order to keep the relatively coarse yarn within the count range of Ne 6 to Ne 16, a voluminous fiber strand is fed, advantageously, from a can to the drafting system.

The inventive method is based on the knowledge that the otherwise negative effect of higher drafts is eliminated by the known exceptional condensing of the fiber between the outlet from the main draft zone and the twist inhibiting nip, while the effect of the improvement in internal silver guidance at higher drafts is maintained. Thus, the higher draft values according to the invention not only improve efficiency but also, surprisingly, substantially improve the quality of the yarn produced. An unexpected and disproportionate improvement is thus achieved.

The method according to the invention can be applied in the processing of rovings of combed cotton, man-made fibers and fiber mixtures.

These and other objects and advantages of the invention will become more apparent from the following detail description taken in conjunction with the accompanying drawings wherein:

FIG. 1 illustrates a schematic side view of a single spinning unit of a ring spinning machine operating in accordance with the invention; and FIG. 2 illustrates a front view of the spinning unit of FIG. 1.

Referring to FIGS. 1 and 2, a silver 11 is fed from a spinning can 12 via a deflection element 28 into a three-cylinder drafting system 13 having a pre-draft zone 23 and a main draft zone 24. As shown, the pre-draft zone 23 includes a pair of feed rollers 37, 37". In addition, a pair of rollers 29, 29" at the end of the pre-draft zone 23 and at the beginning of the main draft zone 24 are equipped, as is known, with aprons 30, 30" which extend into a draw-in nip of a pair of delivery rollers 25, 26.

The lower roller 25 of the pair of delivery rollers 25, 26 is constructed as a perforated suction roller having a substantially larger diameter than the other rollers and is rotatable about a rotational axis 36. The delivery rollers 26 which rotate in opposite directions form the last nip 14 of the drafting system 13.

Following the delivery nip 14, the silver passing through the drafting system 13 is guided along a curved path 15 over a part of the circumference of the suction roller 25 to a twist inhibiting counter roller 27 which, together with the suction roller 25, forms a twist inhibiting nip 16 for the silver. A blowing pipe 31 is also provided above the guide path 15 on or near to the silver passing over the guide path 15 so that air can be blown onto the silver.

As shown in FIG. 2, the suction roller 25 is provided with perforations 35 over the entire circumference but only over a small width of the circumferential wall of the roller 25. The width of the perforations is such that, even allowing for any traversing motion of the fiber strand 22, the fiber strand 22 is constantly in contact with the roller 25 via the perforations 35.

As shown in FIG. 1, the suction roller 25 is provided internally with a concentric screen 32 which is open in the area of the guide path 15. The opening in the screen 32 is disposed so that an air current is produced which flows radially from the outside inwardly due to a negative pressure being maintained within the screen 32. This air current passes through the perforations 35 of the suction roller 25 in the directions indicated by the arrows 34.

After the twist inhibiting nip 16, the silver is passed by twist distribution into a conventional ring spinning device 17 which is equipped with a ring rail 18, ring 19, traveller 20, spindle rail 38 and spindle 21 in order to produce a ring spun yarn 39 from the compact fiber strand 22 emerging from the twist inhibiting nip 16.

In accordance with the invention, the drafting system 13 effects a total draft of from 80 to 100-fold, the draft within the pre-draft zone 23 being only within the normal limits of 1.1 to 1.3-fold.

Following the high-drafts effected essentially within the main draft zone, a bunching of the fiber strand 22 is achieved without drafting in the condensing area (i.e. along the guide path 15) between the nips 14, 16 of the rollers 26, 27. The bunching of the fiber strand 22 to form a fiber strand of not more than 2.5 millimeters in width, and preferably less than 1.5 millimeters, is such that an exceptionally high yarn quality is obtained after the discharged nip 16. The condensing which occurs not only eliminates the effect of the main draft zone widening the silver but also overcompensates for this by a significant improvement in the yarn quality.

Normally, a ring spinning machine has approximately 500 adjacent spinning units. Generally, one loading arm is assigned to four adjacent draft zones. Furthermore, a suction roller such as the roller 25 described above, can be assigned to one loading arm so that, in practice, the suction roller 25 has four adjacently spaced perforation zones 35.

As is known, yarn quality can be measured on a relative basis using Uster® Statistics. In the present case, a yarn produced according to the above method possesses the following properties in accordance with the Uster Statistics 1989.

yarn count within the range of Ne 6 . . . Ne 16 twist factor ($\alpha$m) within the range up to 100 hairiness (H) less than that given by the Uster 25% curve irregularity (CV) less than that given by the Uster 5% curve neps lower than those given by the Uster 5% curve Typically, when condensing the fiber stand along the guide path 15, the strand is condensed to form a compact fiber strand of not more than 2.5 millimeters in width and preferably less than 1.5 millimeters in width.

As noted above, the drafting of the fiber-strand in the drafting system may be in a range of from 60 to 150-fold. Typically, the draft is greater than 65-fold and is carried out in a preferred range of from 70 to 110-fold. A still further preferred draft is from 80 to 100-fold.

The yarn which is produced by the method described above may be characterized as being composed of fibers of a length less than or equal to 60 millimeters and being characterized in having a yarn count in a range of from Ne 6 to Ne 16. In addition, the yarn may be characterized in having a twist factor within a range of up to 100 Uster, a hairiness less than an Uster 25% curve and irregularity less than an Uster 5% curve and neps of less than an Uster 5% curve.

What is claimed is:

1. A ring spinning method comprising the steps of drafting a fiber strand, respectively in a multi-stage drafting system to a total draft in a range of from 60- to 150-fold;

conveying the drafted fiber strand, respectively from the drafting system without drafting over a defined guide path to a twist inhibiting nip between two rollers;

condensing the fiber strand, respectively along said guide path to form a compact fiber strand of not more than 2.5 mm in width; and delivering the compact fiber strand while twisting the fiber strand, respectively to a ring spinning device for twisting into a fully spun yarn having a fineness within a range of from Ne 6 to Ne 16.

2. A method as set forth in claim 1 wherein the fiber strand is condensed to form a compact fiber strand of less than 1.5 mm in width.

3. A method as set forth in claim 1 wherein the total draft is greater than 65 fold.

4. A method as set forth in claim 3 wherein the total draft is from 70 to 110 fold.

5. A method as set forth in claim 3 wherein the total draft is from 80 to 100 fold.

6. A method as set forth in claim 1 wherein the drafting system consists of a pre-drafting zone and a main draft zone.

7. A method as set forth in claim 6 wherein the fiber strand is drafted in the pre-drafting zone in a range of from 1.1 to 1.3 fold.

8. A method as set forth in claim 1 wherein the drafted fiber strand is conveyed over a suction roller in said guide path and between a delivery roller of the drafting system and a roller forming the twist inhibiting nip with the suction roller.

9. A yarn formed by a method as set forth in claim 1.

10. A ring spinning method comprising the steps of drafting a fiber strand in a multi-stage drafting system to a total draft in a range of from 80- to 100-fold;

conveying the drafted fiber strand from the drafting system without drafting on a rotating suction roller in a defined guide path while maintaining the fiber strand thereon to a twist inhibiting nip between the suction roller and another roller;

condensing the fiber strand on the rotating suction roller along said guide path to form a compact fiber strand of not more than 2.5 mm in width; and delivering the compact fiber strand from said twist inhibiting nip while twisting the fiber strand to a ring spinning device for twisting into a fully spun yarn having a fineness within a range of from Ne 6 to Ne 16.

11. A method as set forth in claim 10, wherein the fiber strand is condensed to form a compact fiber strand of less than 1.5 mm in width.

12. A ring spinning method comprising the steps of drafting a fiber strand in a multi-stage drafting system to a total draft greater than 80-fold;

conveying the drafted fiber strand from the drafting system without drafting on a rotating suction roller while maintaining the fiber strand thereon to a twist inhibiting nip between the suction roller and another roller;

condensing the fiber strand on the suction roller to form a compact fiber strand of not more than 2.5 mm in width; and delivering the compact fiber strand from said twist inhibiting nip while twisting the fiber strand to a ring spinning device for twisting into a fully spun yarn having a fineness within a range of from Ne 6 to Ne 16.

13. A method as set forth in claim 12 wherein the fiber strand is condensed to form a compact fiber strand of less than 1.5 mm in width.

* * * * *

UNITED STATES PATENT AND TRADEMARK OFFICE

CERTIFICATE OF CORRECTION

PATENT NO. : 5,651,244

DATED : July 29, 1997

INVENTOR(S) : Angelo Lucca and Herbert Stalder

It is certified that error appears in the above-identified patent and that said Letters Patent is hereby corrected as shown below:

Column 2, lines 5 and 8, "stand" should be -strand-

Signed and Sealed this

Second Day of December, 1997

*Attest:*

*Attesting Officer*

Bruce Lehman

BRUCE LEHMAN

*Commissioner of Patents and Trademarks*